US008165327B2

(12) United States Patent
Pape

(10) Patent No.: US 8,165,327 B2
(45) Date of Patent: Apr. 24, 2012

(54) METHOD FOR GENERATING ACOUSTIC SIGNALS OF A HEARING AID

(75) Inventor: Sebastian Pape, Erlangen (DE)

(73) Assignee: Siemens Audiologische Technik GmbH

( * ) Notice: Subject to any disclaimer, the term of this patent is extended or adjusted under 35 U.S.C. 154(b) by 1115 days.

(21) Appl. No.: 12/012,748

(22) Filed: Feb. 5, 2008

(65) Prior Publication Data

US 2008/0192966 A1 Aug. 14, 2008

(30) Foreign Application Priority Data

Feb. 13, 2007 (DE) ..... 10 2007 007 120

(51) Int. Cl.
*H04R 25/00* (2006.01)

(52) U.S. Cl. ..... 381/312; 381/57; 381/329

(58) Field of Classification Search ..... 381/312, 381/329, 57

See application file for complete search history.

(56) References Cited

U.S. PATENT DOCUMENTS 6,912,289 B2 * 6/2005 Vonlanthen et al. ..... 381/312
7,242,783 B1 * 7/2007 Weeks et al. ..... 381/98

FOREIGN PATENT DOCUMENTS

EP 0 280 909 A1 9/1988
EP 0542 711 A1 5/1993

* cited by examiner

*Primary Examiner* — David Vu
*Assistant Examiner* — Brandon Fox

(57) ABSTRACT

Acoustic signal tones of a hearing aid need to be adjusted to the particular situation so as to be easy to hear, i.e. on the one hand they should not be too loud in quiet situations, and on the other hand they should not be too quiet in noisy situations. In order to fulfill these requirements, the acoustic signals of the hearing aid according to the invention are shifted up or down in frequency if the ambient noises are extremely pronounced, particularly in the frequency band range of the acoustic signals.

4 Claims, 1 Drawing Sheet

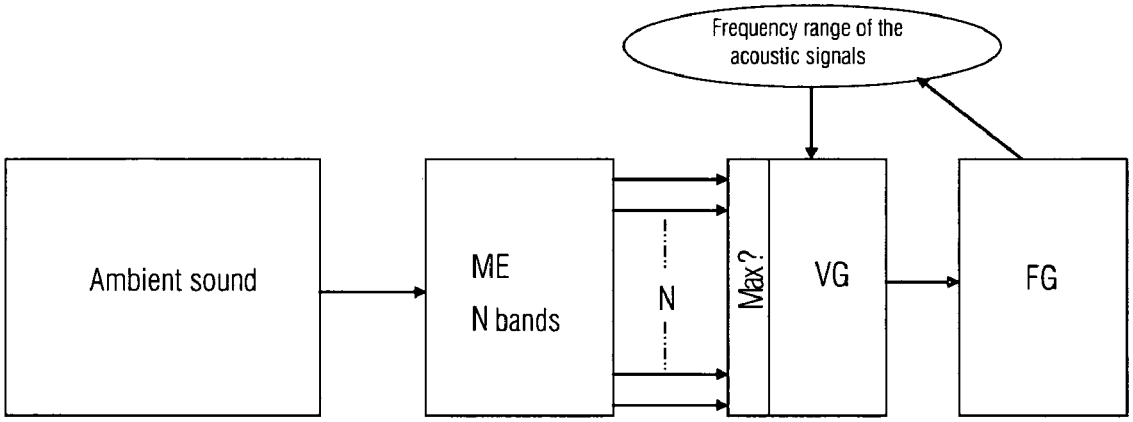
Frequency range of the acoustic signals
Ambient sound
ME
N bands
N
Max?
VG
FG

METHOD FOR GENERATING ACOUSTIC SIGNALS OF A HEARING AID

CROSS REFERENCE TO RELATED APPLICATIONS

This application claims priority of German application No. 10 2007 007 120.7 DE filed Feb. 13, 2007, which is incorporated by reference herein in its entirety.

FIELD OF INVENTION

The present invention relates to a hearing aid and to a method for generating acoustic signals of a hearing aid.

BACKGROUND OF INVENTION

Acoustic signal tones support the hearing aid wearer in many respects. In particular they help the hearing aid wearer in choosing the right program. Essentially there is the problem that the acoustic signal tones need to be adjusted to the particular situation so that they are easy to hear, i.e. on the one hand they should not be too loud in quiet situations, and on the other hand they should not be too quiet in noisy situations.

SUMMARY OF INVENTION

A possible solution is a controller which calculates the level of the acoustic signals as a function of the ambient volume level, i.e. the level of the input signal of the hearing aid. In this way the acoustic signals can be played back quietly in quiet situations and adjusted accordingly, i.e. amplified, in a loud environment. However, the invention is based on the knowledge that with this solution, although it would still not be possible to hear the acoustic signals if the overall level of the environment is within the average range, the level in the frequency range of the acoustic tone signals is relatively high. Thus, acoustic signals with sinusoidal character (e.g. what are referred to as "beeps") have a relatively narrow frequency spectrum and consequently are very easily "masked", i.e. lowered to below the hearing threshold, by an environment of said kind.

According to the invention, the input signal of the hearing aid is analyzed to determine whether the level of the input signal in a (frequency) band range in which there is also an acoustic signal exceeds a specific threshold value. If, on the basis of this analysis, it is established that the said threshold value has been exceeded, then the acoustic signal is adjusted up or down in frequency and thus shifted into a range with less ambient noise. In this range the hearing threshold is lower and consequently the acoustic signal is heard more easily at the same amplification.

In one embodiment the method according to the invention can also be applied in conjunction with the aforementioned method for determining the amplification of an acoustic signal. In this case the overall level of the input signal can be used to calculate the amplification of an acoustic signal and the method according to the invention can be used to determine the need for a frequency shifting of the acoustic signal.

BRIEF DESCRIPTION OF THE DRAWING

The components for implementing the invention are explained below with reference to the drawing which comprises a single FIGURE.

DETAILED DESCRIPTION OF INVENTION

The invention comprises a measuring device ME, a comparator device VG and a frequency-shifting device FG.

The measuring device ME serves for determining a frequency-band-related level maximum for the input signal of the hearing aid. The comparator device VG then firstly compares the frequency range of the maximum with that of the acoustic signals. If both are in the same range, a further comparison is made to determine whether the maximum differs by a threshold value from the level in the other bands. If so, the acoustic signals are shifted in frequency by way of the frequency-shifting device FG into a band in which they are not masked.

The invention claimed is:

1. A method for adjusting acoustic signals in a hearing aid, comprising:

determining whether a level of an input signal of the hearing aid that includes an acoustic signal exceeds a specific threshold value in a frequency band range, wherein the acoustic signal is in the same frequency band range; and shifting the acoustic signal up or down in frequency to a different frequency band range if the threshold value is exceeded, whereby the acoustic signal is heard more easily in the different frequency band where it is not masked.

2. The method as claimed in claim 1, wherein the acoustic signal comprises a sinusoidal signal having a narrow frequency spectrum which is easily masked in noisy environments of the same frequency band range.

3. A hearing aid, comprising:

a measuring device for a frequency-band-related measurement of a level of an input signal of the hearing aid, wherein the input signal includes an acoustic signal in the same frequency band range;

a comparator device for comparing a result returned by the measuring device with a threshold value; and a shifting device for shifting the frequency of the acoustic signal to a different frequency band range from that of the input signal as a function of the result returned by the measuring device, thereby allowing the acoustic signal to be heard more easily in the different frequency band where it is not masked.

4. The hearing aid as claimed in claim 3, wherein the acoustic signal comprises a sinusoidal signal having a narrow frequency spectrum which is easily masked in noisy environments of the same frequency band range.

* * * * *